US009897295B2

(12) United States Patent
Wang

(10) Patent No.: US 9,897,295 B2
(45) Date of Patent: Feb. 20, 2018

(54) LED DISPLAY SCREEN

(71) Applicant: LEYARD OPTOELECTRONIC CO., LTD., Beijing (CN)

(72) Inventor: Dingfang Wang, Beijing (CN)

(73) Assignee: LEYARD OPTOELECTRONIC CO., LTD., Beijing (CN)

( * ) Notice: Subject to any disclaimer, the term of this patent is extended or adjusted under 35 U.S.C. 154(b) by 0 days.

(21) Appl. No.: 15/276,614

(22) Filed: Sep. 26, 2016

(65) Prior Publication Data

US 2017/0321870 A1 Nov. 9, 2017

(30) Foreign Application Priority Data

May 3, 2016 (CN) ..... 2016 1 0286606

(51) Int. Cl.
*F21V 21/14* (2006.01)
*F21V 21/096* (2006.01)
(Continued)

(52) U.S. Cl.
CPC ..... *F21V 21/14* (2013.01); *F21V 21/088* (2013.01); *F21V 21/096* (2013.01); *G09F 9/33* (2013.01);
(Continued)

(58) Field of Classification Search
CPC ..... F21V 21/41; F21V 21/008; F21V 21/096; F21Y 2103/10; F21Y 2115/10; G09F 9/33; G09F 13/22; G09F 2013/222
USPC ..... 362/391, 407, 449, 225, 220, 217.17, 362/217.16, 217.15, 217.14, 249.1, 362/249.11
See application file for complete search history.

(56) References Cited

U.S. PATENT DOCUMENTS 4,849,864 A * 7/1989 Forrest ..... F21S 8/00 362/225
6,450,669 B2 * 9/2002 Buss ..... F21V 21/16 362/217.16
(Continued)

FOREIGN PATENT DOCUMENTS

CA 2 881 041 * 2/2015
CN 103 337 225 A 10/2013
(Continued)

OTHER PUBLICATIONS

Search report for European Patent Application No. 16190407.3, dated Nov. 20, 2017.

*Primary Examiner* — Laura Tso
(74) *Attorney, Agent, or Firm* — Pearl Cohen Zedek Latzer Baratz LLP

(57) ABSTRACT

The invention provides a Light-Emitting Diode (LED) display screen, including: fixing assemblies and a display assembly. The fixing assemblies are provided at an upper side and lower side of the display assembly so as to fix the display assembly. The display assembly includes: an LED display light bar and a connecting structure connected with the LED display light bar. The display assembly further includes an angle adjustment structure provided between the connecting structure and the LED display light bar. The angle adjustment structure can adjust a mounting angle of the LED display light bar. The technical solution of the invention effectively solves the problem in the traditional art that an angle of an LED display light bar cannot be adjusted.

14 Claims, 12 Drawing Sheets

(51) Int. Cl.

| | |
|---|---|
| ***F21V 21/088*** | (2006.01) |
| ***G09F 9/33*** | (2006.01) |
| ***G09F 13/22*** | (2006.01) |
| *F21Y 115/10* | (2016.01) |
| *F21Y 103/10* | (2016.01) |

(52) U.S. Cl.
CPC ..... *G09F 13/22* (2013.01); *F21Y 2103/10* (2016.08); *F21Y 2115/10* (2016.08); *G09F 2013/222* (2013.01)

(56) References Cited

U.S. PATENT DOCUMENTS

| | | | | |
|---|---|---|---|---|
| 9,135,838 | B2 * | 9/2015 | Kline | G09F 9/33 |
| 2003/0137835 | A1 * | 7/2003 | Mier-Langner | F21S 8/06 362/220 |
| 2017/0019970 | A1 * | 1/2017 | Chemel | F21S 2/005 |
| 2017/0023193 | A1 * | 1/2017 | Thosteson | H05B 37/0272 |

FOREIGN PATENT DOCUMENTS

| | | | |
|---|---|---|---|
| WO | WO 2007/035992 | A1 | 4/2007 |
| WO | WO 2013/170306 | A1 | 11/2013 |

* cited by examiner

LED DISPLAY SCREEN

CROSS-REFERENCE TO RELATED APPLICATIONS

This application claims priority from Chinese Patent Application No. 201610286606.5, filed May 3, 2016, which is incorporated herein by reference.

TECHNICAL FIELD OF THE INVENTION

The invention relates to the technical field of display devices, and in particular to a Light-Emitting Diode (LED) display screen.

BACKGROUND OF THE INVENTION

Due to the incomparable advantages of ultra-high definition display, high brightness, low power consumption, long service life and the like compared to a traditional display device such as a liquid crystal screen and a projector, an LED display screen becomes a new favourite of an current field of display, and is widely applied to occasions such as meeting rooms, clubs, shopping malls, studios and monitoring halls.

An existing LED display screen includes light bars, a power control box and a structural frame. The light bars form a display unit on the professionally-produced structural frame by threaded connection or plugged connection, and then the display unit is connected with a frame in a threaded connection mode or other connection modes. Angles of the light bars of the display screen formed in the above mode cannot be adjusted. Since the LED display screen is more and more widely applied, mounting positions thereof are diversified. The angles of the light bars in the display screen in the traditional art cannot be adjusted, thereby making it inconvenient to widely apply the LED display screen.

SUMMARY OF THE INVENTION

A main objective of the invention is to provide an LED display screen, which is intended to solve the problem in the prior art that an angle of an LED display light bar cannot be adjusted.

To this end, the invention provides an LED display screen, which comprises: fixing assemblies; and a display assembly, wherein the fixing assemblies are provided at an upper side and lower side of the display assembly so as to fix the display assembly; the display assembly comprises: an LED display light bar and a connecting structure connected with the LED display light bar; the display assembly further comprises an angle adjustment structure provided between the connecting structure and the LED display light bar; and the angle adjustment structure can adjust a mounting angle of the LED display light bar.

Furthermore, the connecting structure comprises a clamping block, and the LED display light bar installed into the clamping block from a front side of the clamping block and is fixed into the clamping block.

Furthermore, the connecting structure further comprises a steel wire rope, two ends of the steel wire rope are fixed by the fixing assemblies, and the clamping block is provided on the steel wire rope in a penetration manner.

Furthermore, the clamping block comprises a clamp sleeve, the clamp sleeve comprises a first side plate and a second side plate which are provided oppositely and connected with each other, the steel wire rope penetrates through a space between the first side plate and the second side plate, the first side plate is provided with a first opening groove, the second side plate is provided with a second opening groove, the first opening groove and the second opening groove co-form an opening groove structure accommodating the LED display light bar, and the LED display light bar can be installed into an opening groove from an opening of the opening groove structure.

Furthermore, the clamp sleeve further comprises a first front plate and a second front plate, two ends of the first front plate are connected with the first side plate and the second side plate respectively, two ends of the second front plate are connected with the first side plate and the second side plate respectively, and the first front plate and the second front plate are provided at an interval.

Furthermore, the angle adjustment structure is provided in the opening groove, and the LED display light bar comprises a fit portion matched with the angle adjustment structure.

Furthermore, the angle adjustment structure comprises a circular arc plate and a mounting magnetic block provided in the opening groove, multiple angle adjustment holes are provided on the circular arc plate, a first protrusion matched with one of the different angle adjustment holes is provided on the mounting magnetic block, the first protrusion is mounted in different angle adjustment holes in order that the LED display light bar presents different installation angles, and the circular arc plate is made from iron.

Furthermore, a clamping protrusion portion in clamping fit with the clamp sleeve is provided on the circular arc plate.

Furthermore, the mounting magnetic block is further provided with a second protrusion, the second protrusion is provided on a side face, opposite to the first protrusion, of the mounting magnetic block, the fit portion comprises a mounting hole, and the mounting hole is matched with the second protrusion.

Furthermore, the LED display light bar further comprises a main light bar body, the fit portion is an iron sheet connected with the main light bar body, and the mounting holes is provided on the iron sheet.

Furthermore, the clamping block further comprises two lock pins which are provided at a top and bottom of the clamp sleeve respectively so as to fix the clamp sleeve to the steel wire rope.

Furthermore, there are multiple LED display light bars and multiple clamping blocks, the display assembly further comprises steel bars, and at least one steel bar is provided between adjacent LED display light bars.

Furthermore, the multiple LED display light bars are arranged transversely, the steel bar is parallel to each of the LED display light bars, and each of the LED display light bars is as long as the steel bar.

Furthermore, there are multiple groups of steel wire ropes, each group comprising three steel wire ropes. All steel wire ropes are staggered alternately on the steel bar. A middle steel wire rope and two side steel wire ropes in each group of steel wire ropes are located at different sides of the steel bar.

Furthermore, the LED display screen comprises multiple display assemblies, and the fixing assemblies are provided at the upper and lower sides of the multiple display assemblies.

By applying the technical solution of the invention, fixing assemblies are fixed at the peripheral sides of a display assembly, an LED display light bar is connected with a connecting structure, and an angle adjustment structure is provided between the connecting structure and the LED display light bar so as to adjust a mounting angle of the LED display light bar. The angle adjustment structure is disposed between the LED display light bar and the connecting structure, such that the mounting angles of the LED display light bar and the connecting structure can be adjusted as needed so as to meet visual demands of people. The technical solution of the invention effectively solves the problem that the angle of the LED display light bar cannot be adjusted.

BRIEF DESCRIPTION OF THE DRAWINGS

The drawings of the specification, forming a part of the invention, are used to provide further understanding of the invention. The schematic embodiments and illustrations of the invention are used to explain the invention, and do not form improper limits to the invention. In the drawings.

Wherein, the drawings include the following drawing marks:

10, fixing assembly; 20, display assembly; 21, LED display light bar; 22, connecting structure; 221, steel wire rope; 222, clamping block; 2221, first side plate; 2222, second side plate; 2223, first front plate; 2224, second side plate; 2225, lock pin; 23, adjustment structure; 231, circular arc plate; 232, mounting magnetic block; 24, steel bar; and 100, opening groove.

DETAILED DESCRIPTION OF THE EMBODIMENTS

It is important to note that the embodiments of the invention and the characteristics in the embodiments can be combined under the condition of no conflicts. The invention will be illustrated below with reference to the drawings and the embodiments in detail.

Figure 1:
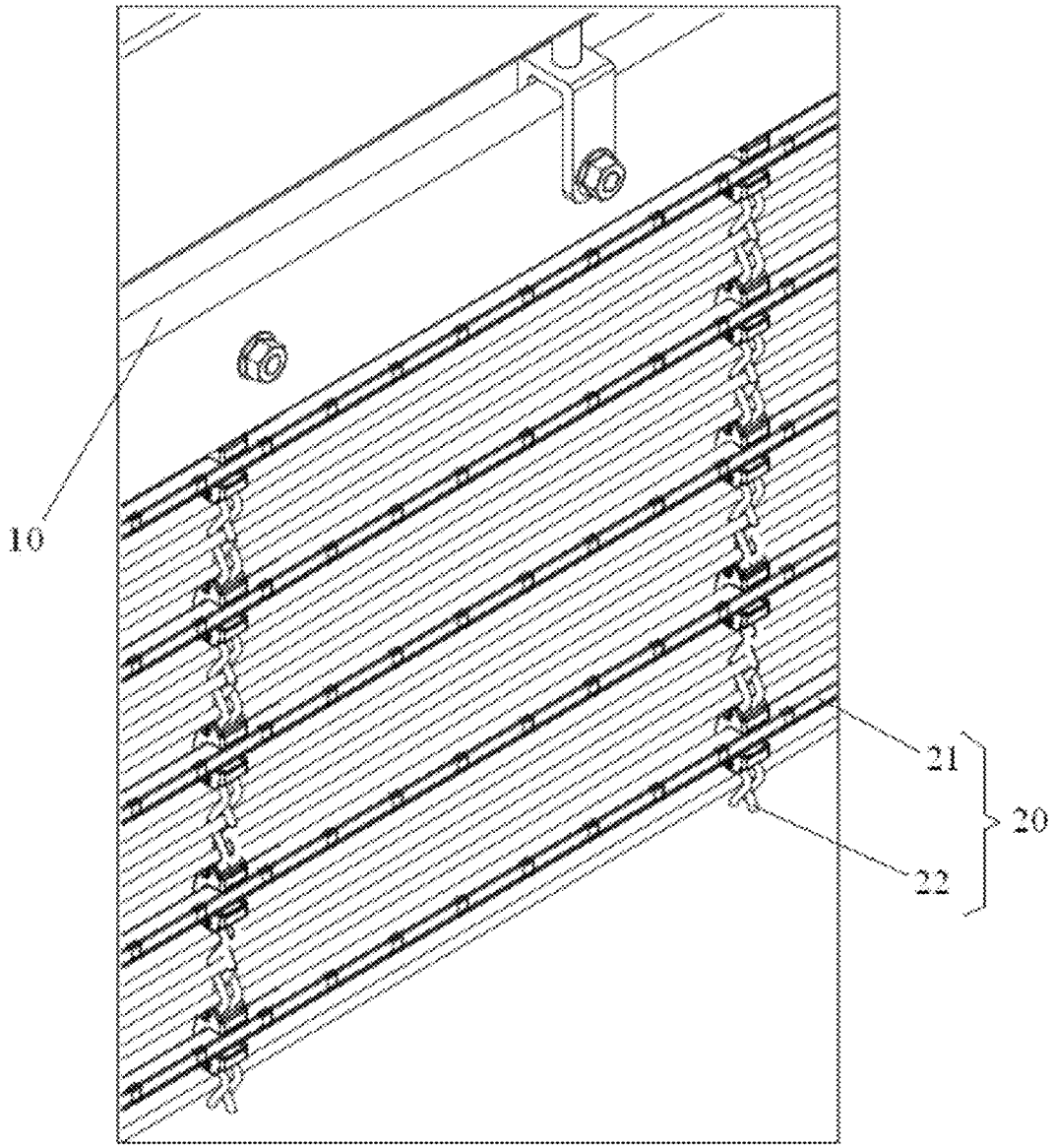
FIG. 1 shows a structural diagram of an embodiment for an LED display screen according to the invention.
Figure 2:
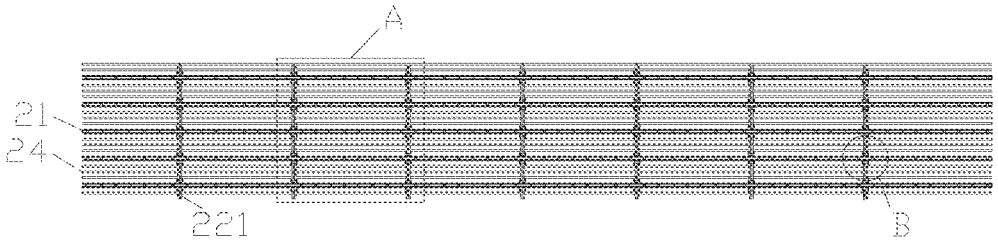
FIG. 2 shows a front view of a display assembly of an LED display screen in FIG. 1.
Figure 3:
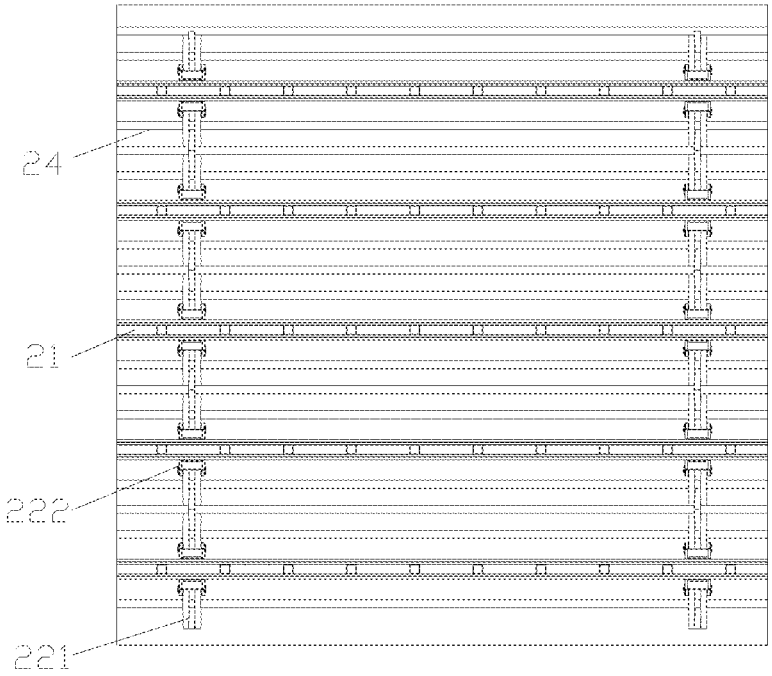
FIG. 3 shows an enlarged view of a part A of a display assembly in FIG. 2.
Figure 4:
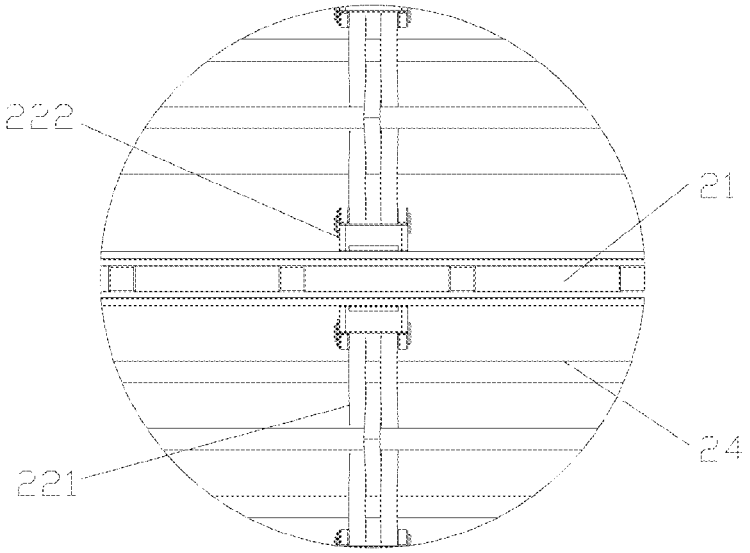
FIG. 4 shows an enlarged view of a part B of a display assembly in FIG. 2.
Figure 5:
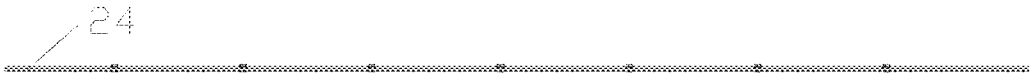
FIG. 5 shows a top view of a display assembly in FIG. 2.
Figure 6:
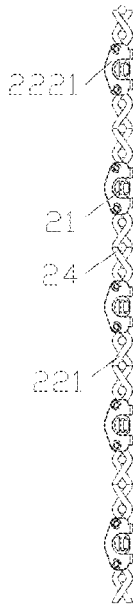
FIG. 6 shows a side view of a display assembly in FIG. 2.
Figure 7:
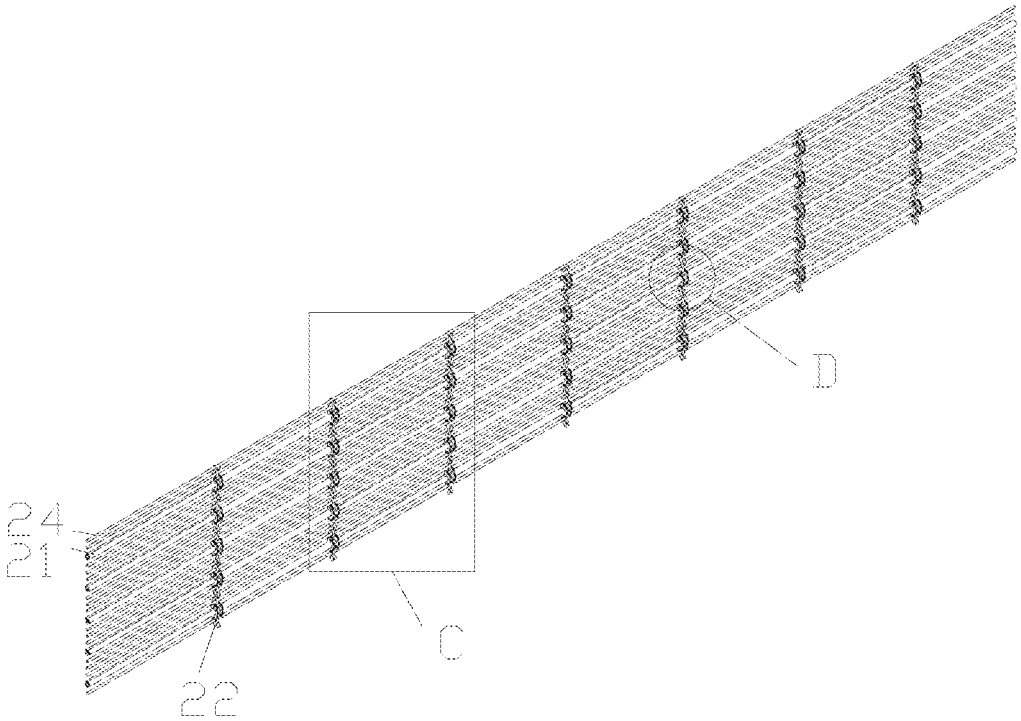
FIG. 7 shows a space diagram of a back surface of a display assembly in FIG. 2.
Figure 8:
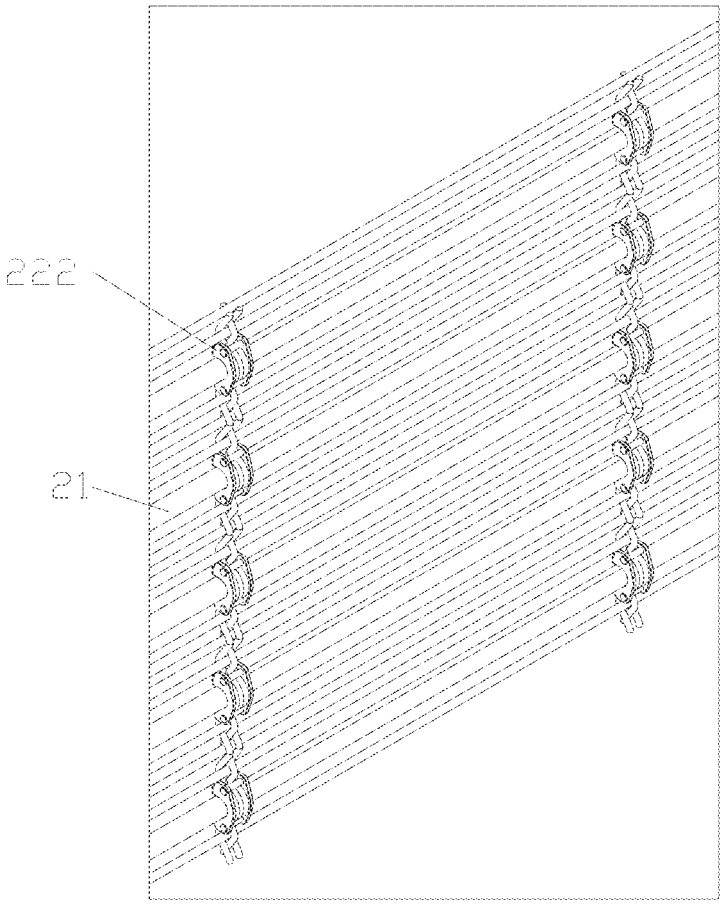
FIG. 8 shows an enlarged view of a part C of a display assembly in FIG. 7.
Figure 10:
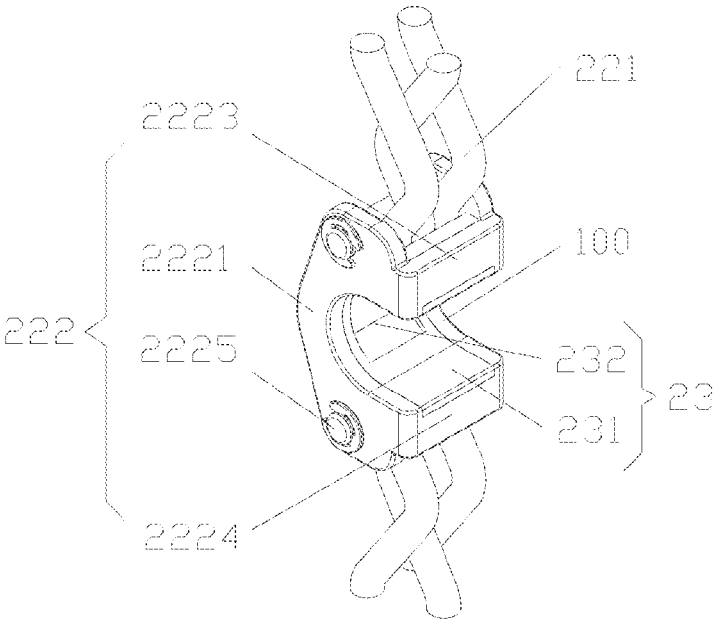
FIG. 10 shows a stereo structure diagram of a clamping piece of a display assembly in FIG. 1.
Figure 11:
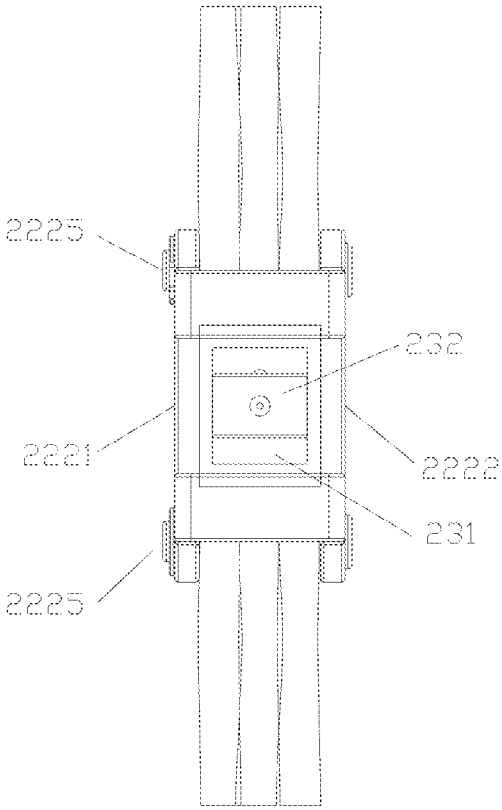
FIG. 11 shows a front view of a clamping piece in FIG. 10.
Figure 12:
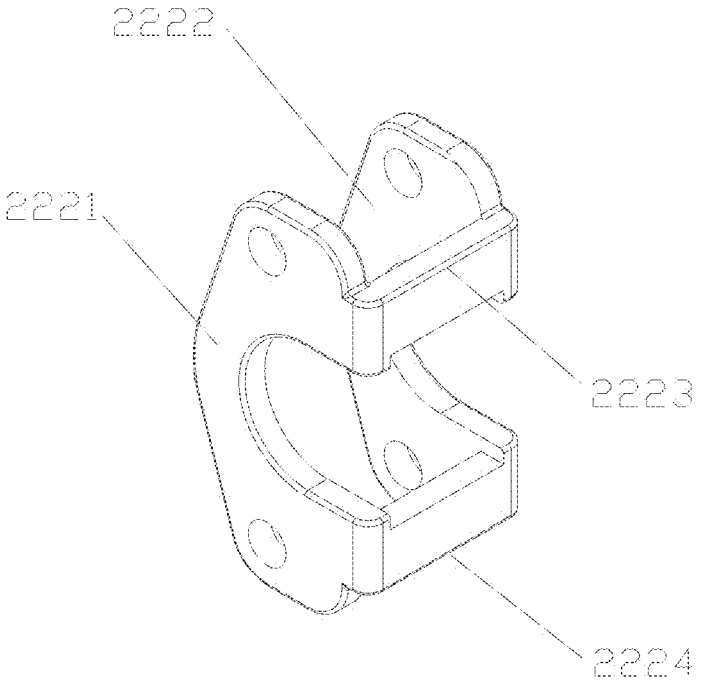
FIG. 12 shows a stereo structure diagram of a clamp sleeve of a display assembly in FIG. 10.
Figure 13:
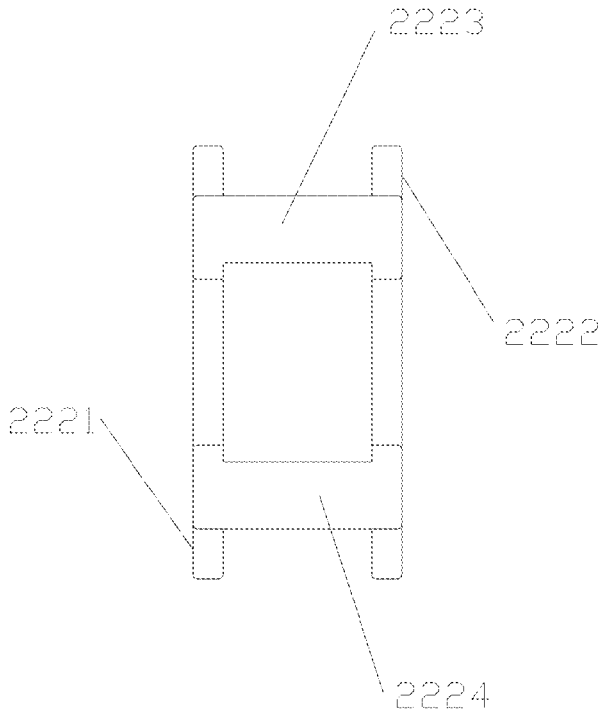
FIG. 13 shows a front view of a clamp sleeve in FIG. 12.
Figure 14:
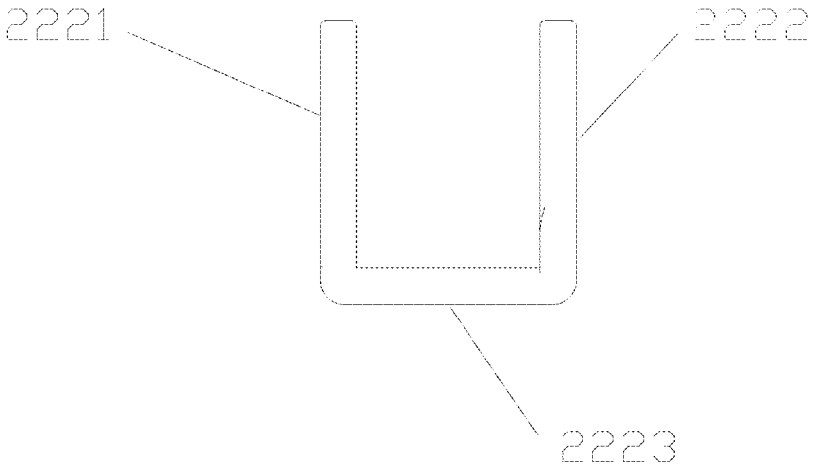
FIG. 14 shows a top view of a clamp sleeve in FIG. 13.
Figure 15:
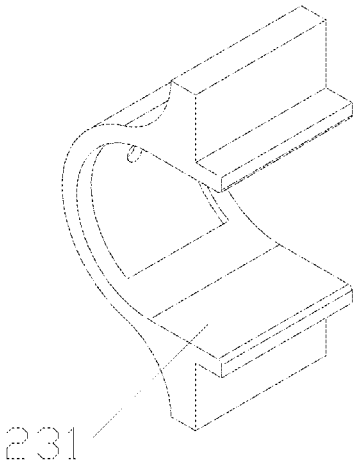
FIG. 15 shows a stereo structure diagram of a circular arc plate of a clamping piece in FIG. 10.
Figure 16:
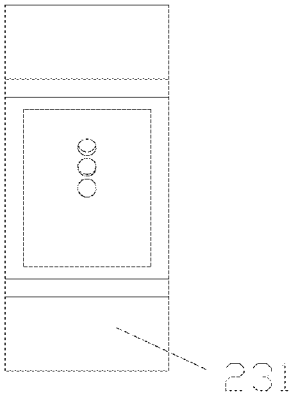
FIG. 16 shows a front view of a circular arc plate in FIG. 15.
Figure 17:
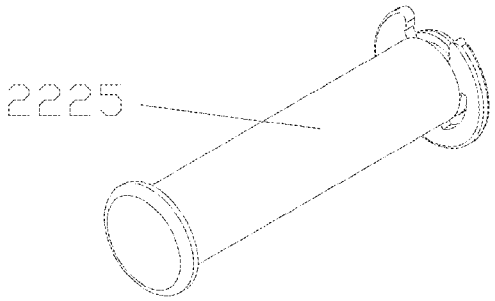
FIG. 17 shows a stereo structure diagram of a lock pin of a clamping piece in FIG. 10.
Figure 18:
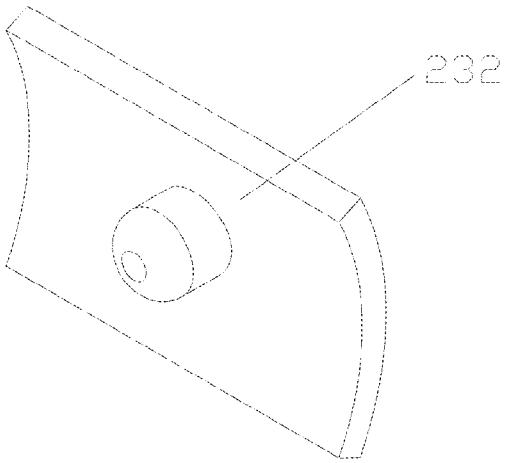
FIG. 18 shows a stereo structure diagram of a mounting magnetic block of a clamping piece in FIG. 10.
Figure 19:
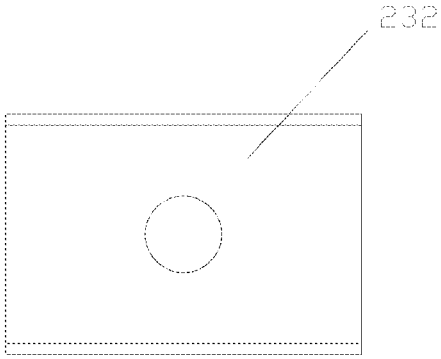
FIG. 19 shows a front view of a mounting magnetic block in FIG. 18.
Figure 20:
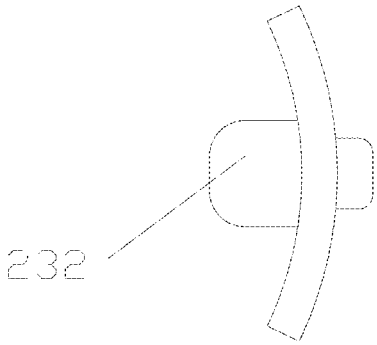
FIG. 20 shows a side view of a mounting magnetic block in FIG. 18.
Figure 21:
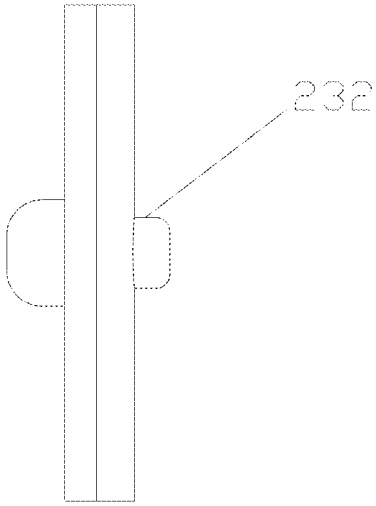
FIG. 21 shows a top view of a mounting magnetic block in FIG. 18.

As shown in FIG. 1 and FIG. 10, an LED display screen of the present embodiment comprises: fixing assemblies 10 and a display assembly 20. The fixing assemblies 10 are provided at an upper side and lower side of the display assembly 20 so as to fix the display assembly 20. The display assembly 20 comprises: an LED display light bar 21 and a connecting structure 22 connected with the LED display light bar 21. The display assembly 20 further comprises an angle adjustment structure 23 provided between the connecting structure 22 and the LED display light bar 21, and the angle adjustment structure 23 can adjust a installation angle of the LED display light bar 21.

By applying a technical solution of the present embodiment, the fixing assemblies 10 are fixed at the upper and lower sides of the display assembly 20, the LED display light bar 21 is connected with the connecting structure 22, and the angle adjustment structure 23 is provided between the connecting structure 22 and the LED display light bar 21 so as to adjust the installation angle of the LED display light bar 21. The angle adjustment structure 23 is provided between the LED display light bar 21 and the connecting structure 22, such that the installation angles of the LED display light bar 21 and the connecting structure 22 can be adjusted as needed so as to meet visual demands of people. The technical solution of the present embodiment effectively solves the problem that the angle of the LED display light bar 21 cannot be adjusted.

As shown in FIG. 1 to FIG. 4, in the technical solution of the present embodiment, the connecting structure 22 comprises a clamping block 222. The LED display light bar 21 is mounted into the clamping block 222 from a front side of the clamping block 222 and is fixed into the clamping block 222. When the LED light bar is mounted into the clamping block 222, the LED light bar is mounted from the front side of the clamping block 222. Certainly, those skilled in the art know that when the LED light bar is dismounted, the LED light bar is dismounted from the front side of the clamping block 222. The structure replaces a traditional structure of dismounting a display unit from a rear side of a display screen. In such a way, when the LED display screen of the present embodiment is mounted, it is unnecessary to reserve a space for dismounting the LED display screen between the rear side of the LED display screen and a wall. The technical solution of the present embodiment saves a mounting space of the LED display screen, and enables the LED display screen to be more flexibly mounted.

As shown in FIG. 2 to FIG. 11, in the technical solution of the present embodiment, the connecting structure 22 further comprises a steel wire rope 221, two ends of the steel wire rope 221 are fixed by the fixing assemblies 10, and the clamping block 222 is provided on the steel wire rope 221 in a penetration manner. The LED display screen with the above structure can adopt, on one hand, a hauling type mounting method, and can support, on the other hand, shaping and mounting of a plane and a curved surface. The technical solution of the present embodiment is flexible in mounting, facilitates mounting, storage, transportation and the like of the LED display screen, and saves the cost. During storage and transportation, the LED display screen can be folded or packaged in a scroll manner.

As shown in FIG. 10 to FIG. 14, in the technical solution of the present embodiment, the clamping block 222 comprises a clamp sleeve, the clamp sleeve comprises a first side plate 2221 and a second side plate 2222 which are provided oppositely and connected with each other, the steel wire rope 221 penetrates through a space between the first side plate 2221 and the second side plate 2222, the first side plate 2221 is provided with a first opening groove, the second side plate 2222 is provided with a second opening groove, the first opening groove and the second opening groove co-form an opening groove structure accommodating the LED display light bar 21, and the LED display light bar 21 can be mounted into an opening groove 100 from an opening of the opening groove structure. The structure is easy to machine and convenient to mount.

As shown in FIG. 10 to FIG. 14, in the technical solution of the present embodiment, the clamp sleeve further comprises a first front plate 2223 and a second front plate 2224, two ends of the first front plate 2223 are connected with the first side plate 2221 and the second side plate 2222 respectively, two ends of the second front plate 2224 are connected with the first side plate 2221 and the second side plate 2222 respectively, and the first front plate 2223 and the second front plate 2224 are provided at an interval. The structure is easy to machine and ingenious to set. Specifically, the first side plate 2221, the second side plate 2222, the first front plate 2223 and the second front plate 2224 are a whole structure.

Figure 9:
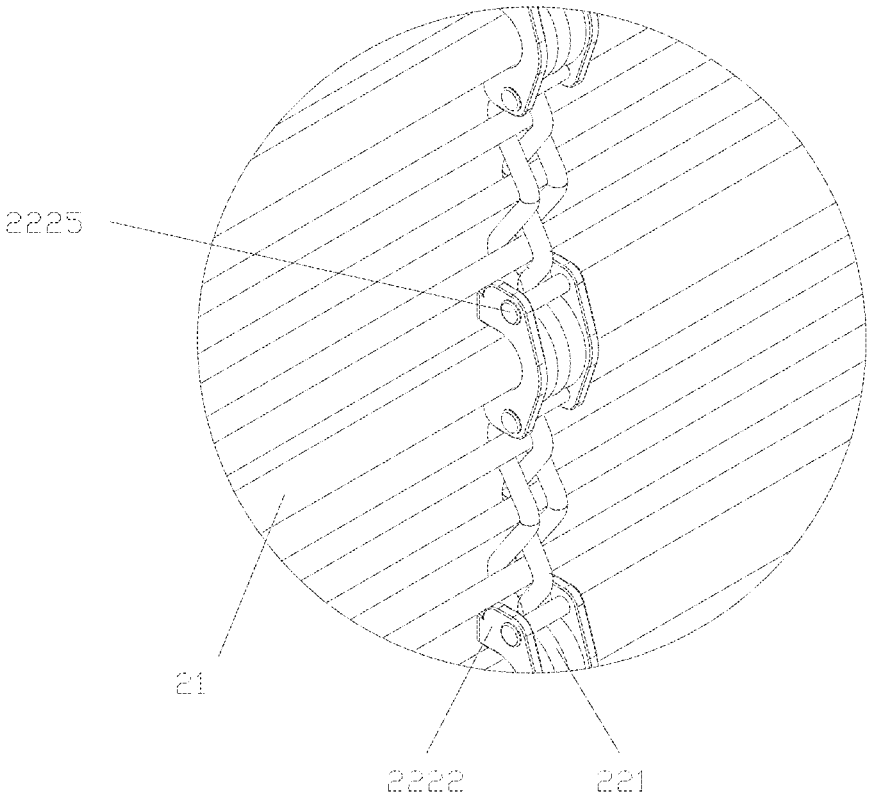
FIG. 9 shows an enlarged view of a part D of a display assembly in FIG. 7.

As shown in FIG. 9 and FIG. 10, in the technical solution of the present embodiment, the angle adjustment structure 23 is provided in the opening groove 100, and the LED display light bar 21 comprises a fit portion matched with the angle adjustment structure 23. The fit portion is provided at a back of the LED display light bar 21, and a shape of the fit portion is matched with that of the angle adjustment structure 23. The structure is compact and needs few materials.

As shown in FIG. 10 to FIG. 21, in the technical solution of the present embodiment, the angle adjustment structure 23 comprises a circular arc plate 231 and a mounting magnetic block 232 provided in the opening groove 100, multiple angle adjustment holes are provided on the circular arc plate 231, a first protrusion matched with one of the angle adjustment holes is provided on the mounting magnetic block 232, the first protrusion is mounted in one of the different angle adjustment holes in order that the LED display light bar 21 presents different installation angles, and the circular arc plate 231 is made from iron. The first protrusion is mounted in one of the angle adjustment holes to position the mounting magnetic block 232, and the mounting magnetic block 232 and the circular arc plate 231 are fixed by magnetism. Certainly, those skilled in the art know that the mounting magnetic block 232 and the circular arc plate 231 can be positioned and fixed via the first protrusion. The mounting magnetic block 232 and the circular arc plate 231 are fixed by a magnetic force. The present embodiment has the advantages of compact structure and easy machining due to the fit between the mounting magnetic block 232 made from a magnet material and the circular arc plate 231 made from iron. The structure also provides a screw-free connecting mode, namely avoids a situation that it is necessary to use a mounting and dismounting tool to mount and dismount fasteners such as screws. In such a way, on one hand, the mounting and dismounting time is shortened, and on the other hand, inconvenience caused by tool carrying is avoided. Specifically, the multiple angle adjustment holes are provided in a middle of the circular arc plate 231 and arranged along the same straight line.

As shown in FIG. 12 to FIG. 16, in the technical solution of the present embodiment, a clamping protrusion portion matched with the clamp sleeve is provided on the circular arc plate 231. Specifically, the clamp sleeve formed by encircling the first side plate 2221, the second side plate 2222, the first front plate 2223 and the second front plate 2224 is a hollow structure. The first front plate 2223 and the second front plate 2224 are provided with an avoidance recess of the circular arc plate 231 separately, the avoidance recess being as thick as the circular arc plate. In such a way, when the circular arc plate 231 is mounted in the clamp sleeve, the circular arc plate 231 is better matched with the clamp sleeve, which will not form protrusions such as steps. The clamping protrusion penetrates into a limiting gap formed by the first side plate 2221, the second side plate 2222, the first front plate 2223 and the second front plate 2224, such that the circular arc plate 231 and the clamp sleeve are assembled together.

As shown in FIG. 18 to FIG. 21, in the technical solution of the present embodiment, the mounting magnetic block 232 is further provided with a second protrusion, the second protrusion is provided on a side face, opposite to the first protrusion, of the mounting magnetic block 232, the fit portion comprises a mounting hole, and the mounting hole is matched with the second protrusion. The second protrusion is mounted in the mounting hole, such that the mounting magnetic block 232 and the LED display light bar 21 achieve positioning fit. Specifically, the LED display light bar 21 further comprises a main light bar body, the fit portion is an iron sheet connected with the main light bar body, and the mounting hole is provided on the iron sheet. The mounting magnetic block 232 and the iron sheet are fixed by a magnetic force. The iron sheet is C-shaped, two ends of the C-shaped iron sheet are connected with the main body of the LED display light bar 21, and the mounting hole is provided in a middle of the C-shaped iron sheet. The main body of the LED display light bar 21 is made from an aluminium alloy material, thereby greatly reducing the mass of the present embodiment. The structure also provides a screw-free connecting mode, namely avoids a situation that it is necessary to use a mounting and dismounting tool to mount and dismount fasteners such as screws. In such a way, on one hand, the mounting and dismounting time is shortened, and on the other hand, inconvenience caused by tool carrying is avoided. Further specifically, in the technical problem of the present embodiment, each fit portion is a mounting hole.

As shown in FIG. 10 to FIG. 17, in the technical solution of the present embodiment, the clamping block 222 further comprises two lock pins 2225, and the two lock pins 2225 are provided at a top and bottom of the clamp sleeve respectively so as to fix the clamp sleeve to the steel wire rope. Specifically, each lock pin 2225 comprises a main lock pin body and a lock pin clamping spring, wherein a first end of the main lock pin body has a stop structure, a second end of the main lock pin body penetrates out of a lock pin hole of the clamp sleeve, the second end of the lock pin is provided with a bayonet matched with the lock pin clamping spring, the lock pin clamping spring is a circular ring sheet with an opening, an outer diameter of the lock pin clamping spring is greater than that of the lock pin hole, and the lock pin is mounted from the opening of the lock pin clamping spring and enters the lock pin clamping spring. In this case, both ends of the lock pins 2225 limit the lock pins 2225 respectively, and the lock pins 2225 cannot be disengaged from the lock pin holes. The steel wire rope 221 is provided at a back (one side away from the LED display light bar 21) of the circular arc plate 231, and the steel wire rope 221 is fastened by means of an acting force between the lock pins 2225 and the circular arc plate 231, such that the clamping block 222 is fixed to the steel wire rope 221.

As shown in FIG. 1 to FIG. 9, in the technical solution of the present embodiment, there are multiple LED display light bars 21 and multiple clamping blocks 222, the display assembly 20 further comprises a steel bar 24, and at least one steel bar 24 is provided between adjacent LED display light bars 21. The number of the steel bar 24 between the adjacent LED display light bars 21 can be set according to actual demands. When an interval between the adjacent LED display light bars 21 is required to be large, more steel bars 24 can be provided, and when an interval between the adjacent LED display light bars 21 is required to be small, few steel bars 24 can be provided. Certainly, those skilled in the art know that the steel bars 24 may not be provided between the adjacent LED display light bars 21. The steel bar 24 may be a cylindrical structure or a plate structure.

As shown in FIG. 1 to FIG. 9, in the technical solution of the present embodiment, the multiple LED display light bars 21 are arranged transversely, the steel bar 24 is parallel to each LED display light bar 21, and each LED display light bar 21 is as long as the steel bars 24. The structure makes a product attractive.

As shown in FIG. 1 to FIG. 9, in the technical solution of the present embodiment, there are multiple groups of steel wire ropes 221, each group comprising three steel wire ropes 221. All steel wire ropes 221 are staggered alternately on the steel bar 24. A middle steel wire rope 221 and two side steel wire ropes 221 in each group of steel wire ropes 221 are located at different sides of the steel bar 24. Specifically, each group of steel wire ropes 221 is vertically arranged to be perpendicular to the LED display light bars 21. Thus, each LED display light bar 21 is evenly stressed. By the through design between every two LED display light bars 21 and between every two steel bars, the technical solution of the present embodiment is low in wind load, and the LED display screen is low in structure weight and safer to use.

Certainly, those skilled in the art know that the fixing assemblies 10 and the display assembly 20 can be assembled in multiple forms. For instance, there are two fixing assemblies 10 namely an upper fixing assembly and a lower fixing assembly. The LED display screen comprises multiple display assemblies 20, and the fixing assemblies 10 are provided at the upper and lower sides of the multiple display assemblies 20. Specifically, when the LED display screen of the present embodiment is mounted, the top is hung, and the lower part is tensioned.

In the technical solution of the present embodiment, the upper fixing assembly fixes the first ends of the steel wire ropes 221, and the lower fixing assembly fixes the second ends of the steel wire ropes 221 so as not to loosen the steel wire ropes 221 wound around the steel bars 24 and the lock pins 2225.

In the technical solution of the present embodiment, there are multiple groups of steel wire ropes 221, each group comprising three multi-strand braided steel wire ropes. Each group of steel wire ropes 221 is arranged in a horizontal extension direction of the LED display light bars 21 in sequence, a single steel bar 24 and the connecting structure 22 are braided into a mesh according to a set interval (an interval between adjacent LED display light bars 21 is equal to the sum of an interval between each LED display light bar 21 and the corresponding steel bar 24, an interval between the steel bars 24 and a width of the steel bars 24 between the adjacent LED display light bars 21, and the number of the steel bars 24 between the LED display light bars 21 can be customized as needed), the braiding length of a single group of braided meshes is not greater than 30m, and the width is equal to the length of the LED display light bars 21 or is an integral multiple of the length of the LED display light bars 21 (and the combination of the multiple display assemblies 20). After braiding of the mesh is completed, the installation angles of the LED display light bars 21 are adjusted as needed display angles, and the LED display light bars 21 are put into the clamping blocks 222 according to needed design angles. The iron sheets are pre-disposed at the mounting positions of the LED display light bars, such that after the LED display light bars are put into the opening grooves 100, assembling of the LED display light bars 21 and the mesh is completed under the strongly magnetic attraction of the mounting magnetic blocks 232 to LEDs. When a certain LED display light bar 21 is maintained, it is only necessary to lightly pry a dismounting position between the corresponding clamping block 222 and the LED display light bar 21 using a screwdriver, so that the LED display light bar 21 can be dismounted. The structure is convenient and quick to mount and dismount. When the LED display screen is mounted, it is only necessary to bolt an upper mesh hanger to a hung cross support of the upper fixing assembly, the lower part of the display assembly 20 is bolted to a cross support of the lower fixing assembly, and then the LED display screen can be firmly assembled by tightening, that is, the LED display screen is completely mounted. From the above descriptions, it can be seen that the embodiment of the invention achieves the technical and beneficial effects of light weight, front dismounting maintenance, adjustable display angle and the like. The present embodiment is convenient to produce and machine, flexible in assembly, small in size, light in weight, high in permeability, small wind resistance, non-necessity of a heavy structural frame on the site and the like. The technical solution of the present embodiment has the effects of portability, simple mounting and simple structure, and it is only necessary to manufacture a hanging beam for hanging during site mounting. In such a way, the present embodiment solves the problems, in the traditional art, of heavy weight, large size, heavy mounting structure, complex construction and high cost of an LED display screen.

The above is only the preferred embodiments of the invention, and is not used to limit the invention. There can be various modifications and variations in the invention for those skilled in the art. Any modifications, equivalent replacements, improvements and the like within the spirit and principle of the invention shall fall within the protective scope of the invention.

The invention claimed is:

1. A Light-Emitting Diode (LED) display screen, comprising:

fixing assemblies; and a display assembly, wherein the fixing assemblies are provided at a first side of the display assembly and a second side of the display assembly so as to fix the display assembly, wherein the second side is opposite to the first side; the display assembly comprises: an LED display light bar and a connecting structure connected with the LED display light bar; the display assembly further comprises an angle adjustment structure provided between the connecting structure and the LED display light bar; and the angle adjustment structure can adjust a mounting angle of the LED display light bar;

wherein the connecting structure comprises a clamping block, and the LED display light bar is installed into the clamping block from a front side of the clamping block and is fixed into the clamping block, wherein the front side of the clamping block is located on a plane which is intersected by both the first side and second side of the display assembly.

2. The LED display screen according to claim 1, wherein the connecting structure further comprises a steel wire rope, two ends of the steel wire rope are fixed by the fixing assemblies, and the clamping block is provided on the steel wire rope in a penetration manner.

3. The LED display screen according to claim 2, wherein the clamping block comprises a clamp sleeve, the clamp sleeve comprises a first side plate and a second side plate which are provided oppositely and connected with each other, the steel wire rope penetrates through a space between the first side plate and the second side plate the first side plate is provided with a first opening groove, the second side plate is provided with a second opening groove, the first opening groove and the second opening groove co-form an opening groove structure accommodating the LED display light bar, and the LED display light bar can be installed into an opening groove from an opening of the opening groove structure.

4. The LED display screen according to claim 3, wherein the clamp sleeve further comprises a first front plate and a second front plate, two ends of the first front plate are connected with the first side plate and the second side plate respectively, two ends of the second front plate are connected with the first side plate and the second side plate respectively, and the first front plate and the second front plate are provided at an interval.

5. The LED display screen according to claim 4, wherein the angle adjustment structure is provided in the opening groove, and the LED display light bar comprises a fit portion matched with the angle adjustment structure.

6. The LED display screen according to claim 5, wherein the angle adjustment structure comprises a circular arc plate and a mounting magnetic block provided in the opening groove, multiple angle adjustment holes are provided on the circular arc plate, a first protrusion matched with one of the different angle adjustment holes is provided on the mounting magnetic block, the first protrusion is mounted in different angle adjustment holes in order that the LED display light bar presents different installation angles, and the circular arc plate is made from iron.

7. The LED display screen according to claim 6, wherein a clamping protrusion portion in clamping fit with the clamp sleeve is provided on the circular arc plate.

8. The LED display screen according to claim 6, wherein the mounting magnetic block is further provided with a second protrusion, the second protrusion is provided on a side face, opposite to the first protrusion, of the mounting magnetic block, the fit portion comprises a mounting hole, and the mounting hole is matched with the second protrusion.

9. The LED display screen according to claim 8, wherein the LED display light bar further comprises a main light bar body, the fit portion is an iron sheet connected with the main light bar body, and the mounting hole is provided on the iron sheet.

10. The LED display screen according to claim 7, wherein the clamping block further comprises two lock pins, and the two lock pins are provided at a top and bottom of the clamp sleeve respectively so as to fix the clamp sleeve to the steel wire rope.

11. The LED display screen according to claim 10, wherein there are multiple LED display light bars and multiple clamping blocks, the display assembly further comprises steel bars, and at least one steel bar is provided between adjacent LED display light bars.

12. The LED display screen according to claim 11, wherein the multiple LED display light bars are arranged transversely, the steel bar is parallel to each of the LED display light bars, and each of the LED display light bars is as long as the steel bar.

13. The LED display screen according to claim 11, wherein there are multiple groups of steel wire ropes, each group comprising three steel wire ropes; all steel wire ropes are staggered alternately on the steel bar; and a middle steel wire rope and two side steel wire ropes in each group of steel wire ropes are located at different sides of the steel bar.

14. The LED display screen according to claim 10, comprising multiple display assemblies, wherein the fixing assemblies are provided at the first and second sides of the multiple display assemblies.

* * * * *